US006102596A

United States Patent [19]

Komori et al.

[11] Patent Number: 6,102,596

[45] Date of Patent: Aug. 15, 2000

[54] PRINTING DEVICE WITH CUTTER

[75] Inventors: Masayoshi Komori, Hirakata; Tohru Arakawa, Nishinomiya; Shozoh Shiraga, Hirakata; Yuji Doi, Katano; Toshio Tanaka, Kyotanabe; Kazumine Koshi, Hirakata, all of Japan

[73] Assignee: Matsushita Electric Industrial Co., Ltd., Osaka, Japan

[21] Appl. No.: 09/171,462

[22] PCT Filed: Feb. 18, 1998

[86] PCT No.: PCT/JP98/00675

§ 371 Date: Oct. 20, 1998

§ 102(e) Date: Oct. 20, 1998

[87] PCT Pub. No.: WO98/36881

PCT Pub. Date: Aug. 27, 1998

[30] Foreign Application Priority Data

| | | | |
|---|---|---|---|
| Feb. 20, 1997 | [JP] | Japan | 9-035882 |
| Mar. 27, 1997 | [JP] | Japan | 9-075411 |
| May 12, 1997 | [JP] | Japan | 9-120602 |
| May 14, 1997 | [JP] | Japan | 9-123681 |

[51] Int. Cl.[7] ..... B41J 11/70

[52] U.S. Cl. ..... 400/621

[58] Field of Search ..... 400/621, 691, 400/692, 693; 101/226, 227; 83/483, 485, 486, 487, 488, 489

[56] References Cited

U.S. PATENT DOCUMENTS

| | | | |
|---|---|---|---|
| 4,504,162 | 3/1985 | Speraggi | 400/621 |
| 4,525,088 | 6/1985 | Shipos et al. | 400/621 |
| 4,981,059 | 1/1991 | Kobayashi | 83/485 |
| 5,188,271 | 2/1993 | Dannatt | 226/102 |
| 5,575,575 | 11/1996 | Ide et al. | 400/320 |
| 5,882,128 | 3/1999 | Hinojosa | 400/621 |

FOREIGN PATENT DOCUMENTS

| | | | |
|---|---|---|---|
| 197806 | 6/1978 | Germany | 400/621 |
| 62-271770 | 11/1987 | Japan | 400/621 |

*Primary Examiner*—Christopher A. Bennett

*Attorney, Agent, or Firm*—Wenderoth, Lind & Ponack, L.L.P.

[57] ABSTRACT

The present invention relates to a printing apparatus for use with portable terminals, measuring instruments, etc. and more particularly to a printing apparatus equipped with a paper cutter having a function for cutting recording paper after printing, and it aims at providing a printing apparatus equipped with a paper cutter that is small, light and thin with considerably a simple structure. In order to achieve this object, the printing apparatus equipped with a paper cutter of the invention is so constructed that a portion of a cutter motor (31) fits in a space provided adjacent to a printer motor (25) when a cutter unit (27) and a printer unit (21) are assembled in piles, and, with this structure, either both or one of the motors are able to utilize efficiently spaces or a space available adjacent to the both or the other of the motors, thereby providing the printing apparatus equipped with a paper cutter, which is small, light and thin with considerably a simple structure.

17 Claims, 15 Drawing Sheets

PRINTING DEVICE WITH CUTTER

FIELD OF THE INVENTION

The present invention relates to a printing apparatus for use with portable terminals, measuring instruments, etc., and more particularly, to a printing apparatus equipped with a paper cutter having a function of cutting recording paper after printing.

BACKGROUND OF THE INVENTION

There has been an increased demand in recent years for printing apparatuses, used in conjunction with portable terminals, numerous kinds of measuring instruments, etc., that are equipped with a paper cutter capable of automatically cutting recording paper after printing, in addition to a demand for a reduction in their sizes, and weights, as well as in the thicknesses.

A printing apparatus equipped with a paper cutter of the kind as shown in FIGS. 18A, 18B and 18C is generally known. That is, FIG. 18A is a typical side view depicting an outline of a printing apparatus equipped with a paper cutter of the prior art, FIG. 18B is a plan view depicting an outline of a cutter unit, and FIG. 18C is a plan view depicting an outline of a printer unit.

In the drawings, a printer unit I is a portion that prints on a recording paper 2, and it comprises a platen roller 3 for feeding paper, a printer motor 5 for driving the platen roller 3 via a series of gears 4 and a printer head 6 for printing on the recording paper 2. A cutter unit 7 is a portion that cuts the recording paper 2 after printing, and it comprises a stationary blade 8, a movable blade 9 and a cutter motor 11 for moving the movable blade 9 toward the stationary blade 8 via a gear 10.

With the above structure, the recording paper 2 is transferred by the platen roller 3, guided to an exit port (not shown in the drawing) after being printed on by the printer head 6, and the recording paper 2 is cut by snipping the recording paper 2 with the stationary blade 8 and the movable blade 9.

However, since in a majority of the printing apparatuses known in the past, the recording papers have been cut by hand after printing, whether the cutter unit 7 is attached or not has depended on the request of the user in most cases. For this reason, the cutter unit 7 has merely been a device that is selected according to a width of the papers and is placed upon the printer unit 1, if one is to be attached.

Therefore, there is a limitation in reducing the size, weight and thickness of the printing apparatus equipped with a paper cutter. With regard to the reduction of thickness in particular, it is impossible to make it equal to or below the thickness of the printer motor 5 and the cutter motor 11.

SUMMARY OF THE INVENTION

The present invention resolves the above-cited problems, and aims at providing a printing apparatus equipped with a paper cutter which is small, light and thin, and with a considerably simple structure.

In order to achieve this object, a printing apparatus equipped with a paper cutter of the present invention is so constructed that a portion of a motor fits in a space provided adjacent to the other motor when a cutter unit and a printer unit are assembled in a stack. With this structure, either each of the motors or one of the motors are able to utilize efficiently the spaces or space available adjacent to each or the one of the motors, thereby providing a printing apparatus equipped with a paper cutter which is small, light and thin, and with a considerably simple structure.

DESCRIPTION OF THE PREFERRED EXEMPLARY EMBODIMENTS

Exemplary Embodiment 1

An overall structure of a printing apparatus equipped with a paper cutter of the present invention is described hereinafter by referring to FIG. 1 through FIG. 3.

Figure 1A:
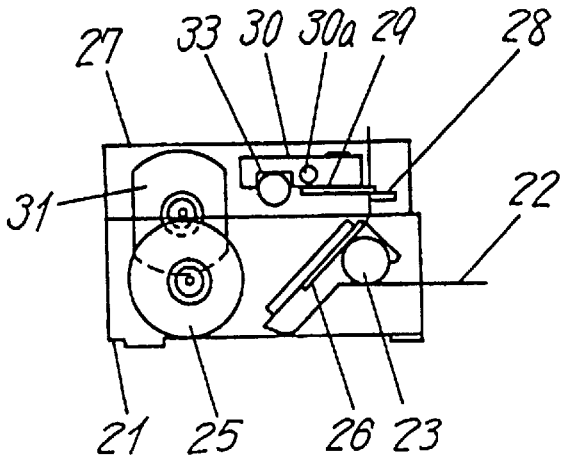
FIG. 1A is a typical side view depicting an outline of a printing apparatus equipped with a paper cutter of a first exemplary embodiment of the present invention.
Figure 1B:
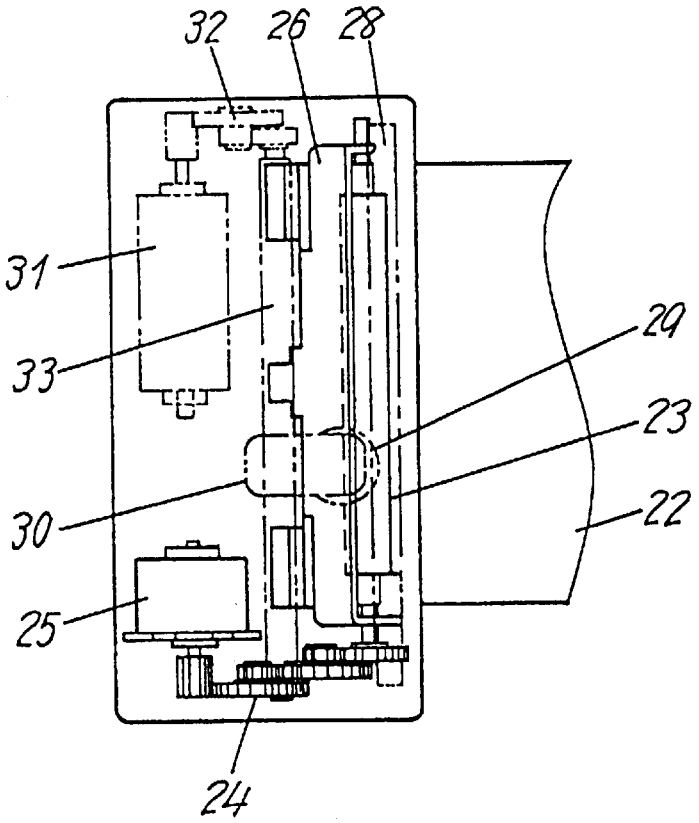
FIG. 1B is a typical top view of the same.
Figure 2A:
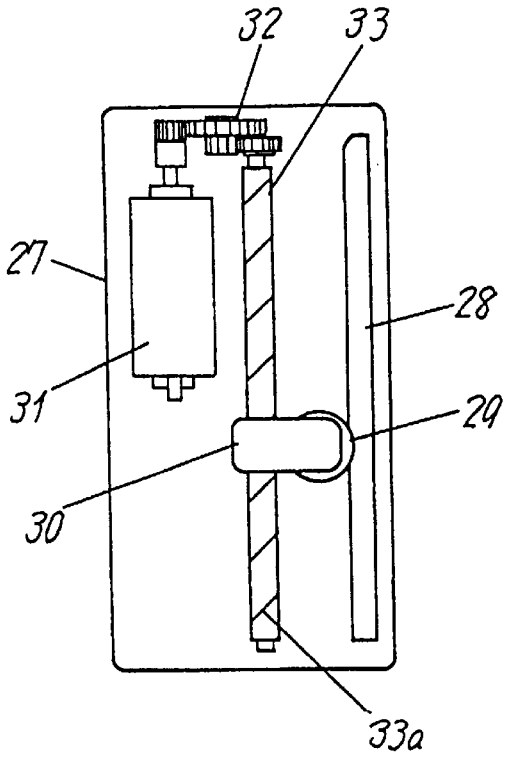
FIG. 2A is a view of a cutter unit of the same exemplary embodiment.
Figure 2B:
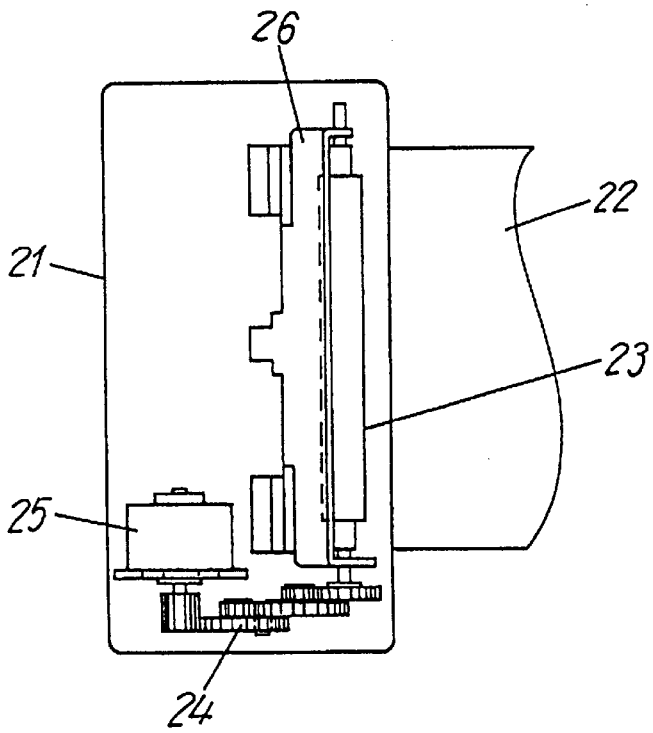
FIG. 2B is a plan view of a printer unit of the same.
Figure 3A:
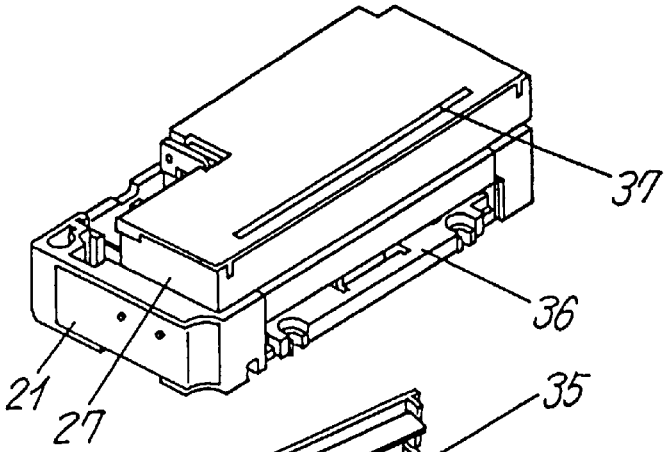
FIG. 3A is a perspective view showing the same exemplary embodiment while in use.
Figure 3B:
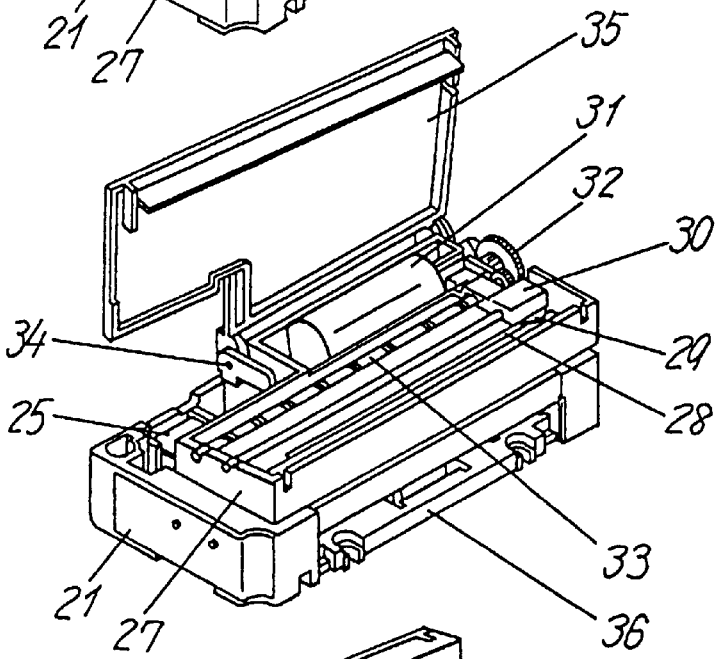
FIG. 3B is a perspective view showing the same with a cover of the cutter unit in an open position.
Figure 3C:
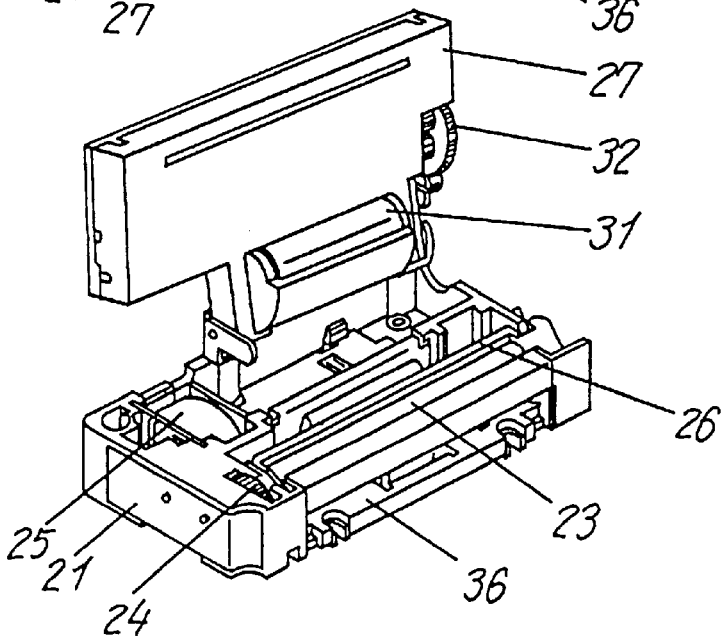
FIG. 3C is a perspective view showing the same with the cutter unit in a lifted position.

FIGS. 1 are typical side views for use in describing outline structures of a printing apparatus equipped with a paper cutter of a first exemplary embodiment of the present invention, as FIG. 1A is a typical drawing as viewed from one side and FIG. 1B is a typical drawing as viewed from the top (alternating long and short dashed lines indicate positional arrangements of structural components of a cutter unit). FIGS. 2A–2B are plan views for use in describing outline structures of the same exemplary embodiment, as FIG. 2A is a plan view of the cutter unit, and FIG. 2B is a plan view of a printer unit. FIGS. 3A–3C are perspective views for use in describing outline structures of the same exemplary embodiment, as FIG. 3A is a perspective view while in use, FIG. 3B is a perspective view when a cover of the cutter unit is in an open position, and FIG. 3C is a perspective view when the cutter unit is in a lifted position.

In Figs. 1A–1C and FIGS. 2A–2B, numeral 21 represents the printer unit for printing on recording paper 22, and comprises a platen roller 23, a series of gears 24, a printer motor 25 and a printer head 26. The platen roller 23 is axially supported for being bi-directionally rotatable, one end of which is provided with a driving force from the printer motor 25 via the series of gears 24 on the side of the printer, while elastically contacting the printer head 26, and is composed so as to be capable of carrying the recording paper 22 by holding it together with the printer head 26.The printer head 26 is positioned to be movable in a direction so as to separate from the platen roller 23, is provided with a heating element (not shown in the drawings) at a side facing toward the platen roller 23, and is constructed so as to be pressed at an opposite side by a pressing member (not shown in the drawings) comprising a leaf spring, etc., during printing.

A numeral 27 represents a cutter unit for cutting the recording paper 22 after printing, and comprises a stationary blade 28, a rotary blade 29, a carriage 30, a cutter motor 31, a series of gears 32 on a cutter side and a transfer axle 33. The rotary blade 29 is axially supported on the carriage 30 to be rotatable, and is constructed to be able to cut the recording paper 22 by way of snipping it together with the stationary blade 28.The carriage 30 is slidably supported by a carriage shaft 30*a* (a part of which is shown in FIG. 1A only) extending along a direction of the breadth of the paper, as it is constructed to be capable of cutting the paper in the direction of the paper breadth by travel of the carriage 30 as the transfer axle 33 rotates. The transfer axle 33 is axially supported to be bi-directionally rotatable, with one end provided with a driving force of the cutter motor 31 via the series of gears 32 on the cutter side, and is so constructed that the carriage 30 is reciprocally movable in the direction of the breadth of the paper along the transfer axle 33 by connecting a groove 33*a* provided on the transfer axle 33 with a connecting part (not shown) as the transfer axle 33 rotates in forward and reverse directions.

Since the printer unit 21 and the cutter unit 27 are constructed so that the cutter unit 27 and a cover 35 are axially supported by a common axle 34, the printer unit 21 is covered almost entirely by the cutter unit 27.The cutter unit 27 is also covered in its entirety by the cover 35 when the printer unit 21 and the cutter unit 27 are assembled in a stack as shown in FIGS. 3A–3C, and so they prevent the entrance of dust and the like, and if jammed papers occur they are easily removed as each unit is separately openable.

Also, the printer unit 21 and the cutter unit 27 are so constructed that when they are assembled in a stack, a portion of the cutter motor 31 that projects from the cutter unit 27 toward the printer unit 21 fits well in an empty space beside the printer motor 25 within the printer unit 21, thereby substantially reducing the thickness of the overall printing apparatus.

Although the described exemplary embodiment has a structure wherein a portion of the cutter motor 31 is placed in the empty space of the printer unit 21, this is not an exclusive construction, and they can be constructed so that a portion of the printer motor 25 fits in an empty space of the cutter unit, or so that both of the motors fit reciprocally into empty spaces of their counterparts. Obviously, the same effect is attained if the cutter motor 31 and the printer motor 25 are arranged side by side even slightly.

With the above-described structure, the recording paper 22 is transferred by the platen roller 23 by passing it through a paper feeding port 36, and guided to a paper exit port 37 after being printed by the printer head 26.The recording paper 22 is cut by way of snipping the recording paper 22 with the stationary blade 28 and the rotary blade 29 and moving the carriage 30 to travel along the transfer axle 33 in the direction of the paper breadth.

Furthermore, by controlling the magnitude of the travel of the carriage 30 in the direction of the breadth by the paper of regulating the number of revolutions of the transfer axle 33 or by detecting a position of the carriage 30 with a sensor (not shown), a switch-over is possible between a full-cutting that cuts the recording paper 22 completely and a partial-cutting that leaves the recording paper 22 partially uncut.

Exemplary Embodiment 2

As a second exemplary embodiment, a concrete structure of a cutter unit for the printing apparatus equipped with a paper cutter of the present invention is described hereinafter by referring to FIG. 4A through FIG. 6.

Figure 4A:
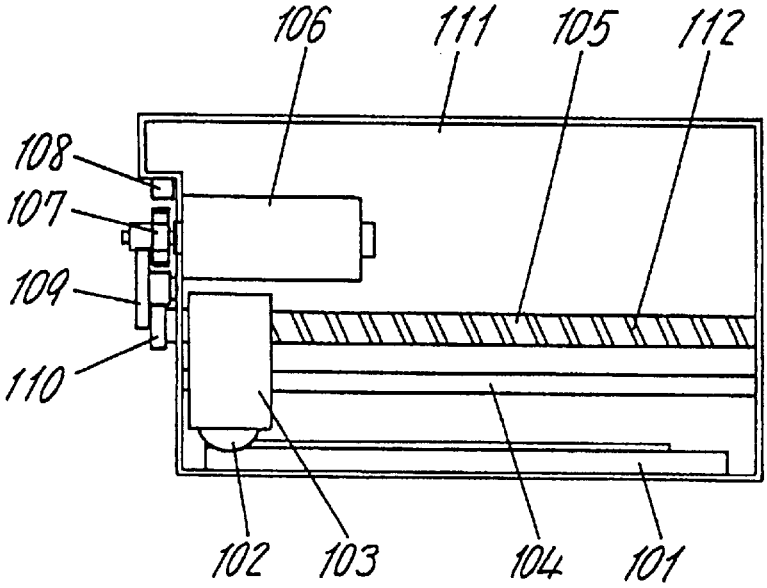
FIG. 4A is a plan view depicting a structure of a cutter unit of a second exemplary embodiment of the present invention.
Figure 4B:
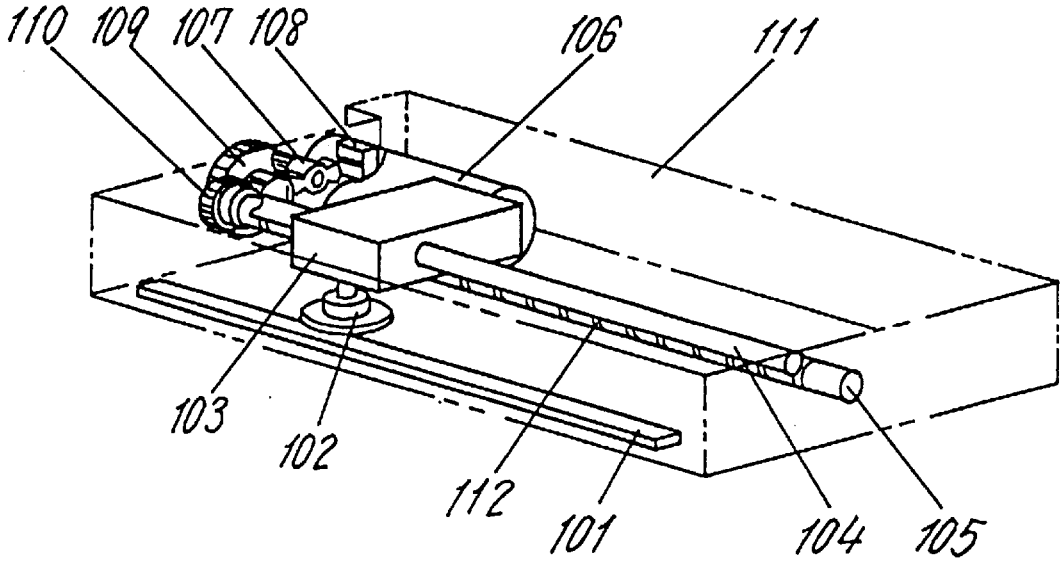
FIG. 4B is a perspective view of the same.
Figure 5:
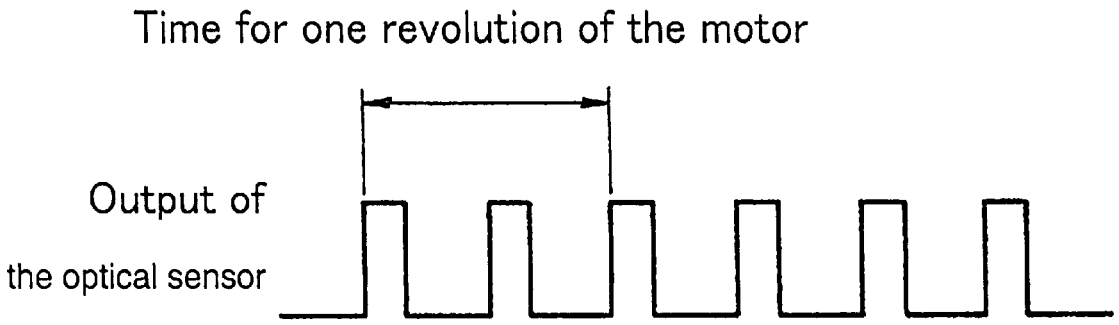
FIG. 5 is a timing chart for the second exemplary embodiment.

FIG. 4A and FIG. 4B are a plan view and a perspective view depicting a structure of the cutter unit of the second exemplary embodiment of the present invention, and FIG. 5 is a timing chart for the same exemplary embodiment.

In Figs.4A–4B, a numeral 101 represents a stationary blade, a numeral 102 represents a circular blade cutter, a numeral 103 is a carriage for rotatably supporting the circular blade cutter 102 for cutting recording paper as it travels parallel with the stationary blade 101, numeral 104 is a carriage shaft for slidably supporting the carriage 103 along the stationary blade 101, numeral 105 is a rotary axle for slidably supporting the carriage 103, numeral 106 is a motor for providing a driving force, numeral 107 is a light reflector formed in one body with a gear to be driven by the motor 106, numeral 108 is a reflection type optical sensor disposed in a position facing toward the light reflector 107, numeral 109 is a reduction gear for transmitting the driving force of the motor 106, numeral 110 is a gear for driving the rotary axle 105 with rotation of the reduction gear 109, numeral 111 is a frame for supporting both ends of the carriage shaft 104, for supporting pivots at both ends of the rotary axle 105 for making it rotatable, and for supporting the motor 106 and the reflection type optical sensor 108, and numeral 112 is a groove provided on the rotary axle 105.

In the above-described structure, the driving force transmitted by the motor 106 to the light reflector 107 drives the gear 110 to rotate via the reduction gear 109. When the rotary axle 105 rotates with the rotation of the gear 110, the carriage 103 reciprocates from side to side by the groove 112 of the rotary axle 105. As the carriage 103 travels along the carriage shaft 104, the circular blade cutter 102 moves along the stationary blade 101 while rotating and cuts off the recording paper (not shown). At this time, output signals, which are synchronized with the revolution of the motor 106, are generated by the light reflector 107 at the reflection type optical sensor 108. There is a relationship as shown in the FIG. 5 between the above-described operation and the output signals generated by the reflection type optical sensor 108.

In this exemplary embodiment, as has been described, since the output signals of the reflection type optical sensor 108 are synchronized with the travelling distance of the carriage 103, a moving distance of the circular blade cutter 102, which is the travelling distance of the carriage 103, can be controlled by counting the output signals. Consequently, the apparatus becomes less expensive, because wiring material for a connection as a means to obtain output signals from the reflection type optical sensor need not be of a good flexing characteristic as has been required for the prior art, since the output signals are obtained without moving the sensor. Furthermore, cut lengths of the recording paper do not disperse, and an effective reduction in the assembling process is achieved, since the light reflector does not need to be mounted at a cutting area of the recording paper.

Figure 6:
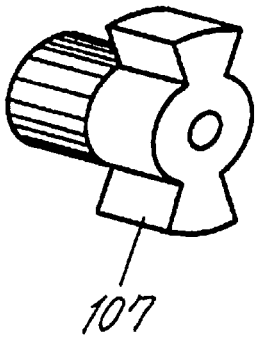
FIG. 6 is a perspective view showing a structure of a light reflector for the second exemplary embodiment.

Although the light reflector 107 is formed in one body with the gear as shown in FIG. 6 in this exemplary embodiment, the same effect is attainable if it is made from two separately fabricated parts made into one piece by insertion, or if the light reflecting portion is provided with a concave at a simple circular end or provided with a light reflecting plate instead of the shape of a long snare drum.

Exemplary Embodiment 3

A concrete structure of a cutter unit for the printing apparatus equipped with a paper cutter of the present invention is described hereinafter as a third exemplary embodiment by referring to FIGS. 7A–7B and FIGS. 8A–8B.

Figure 7A:
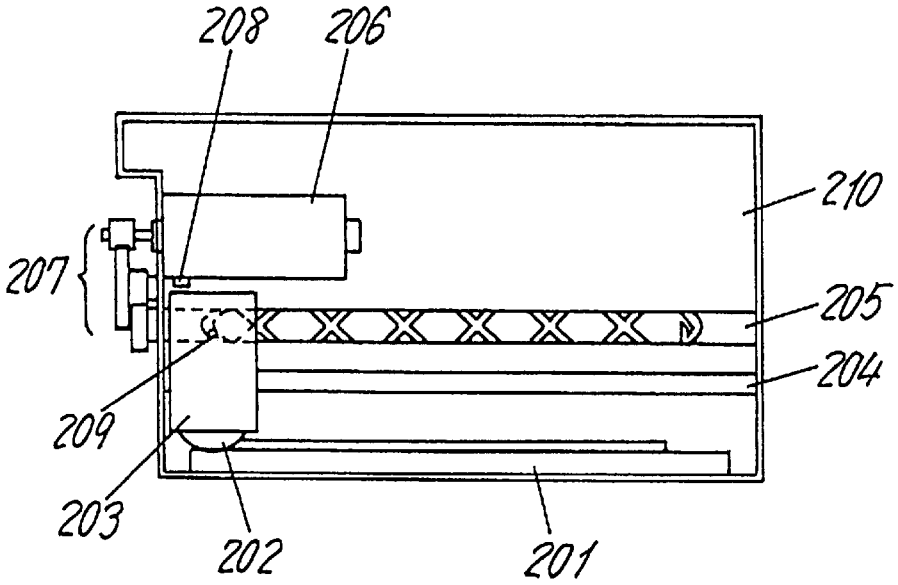
FIG. 7A is a plan view depicting a structure of a cutter unit of a third exemplary embodiment of the present invention.
Figure 7B:
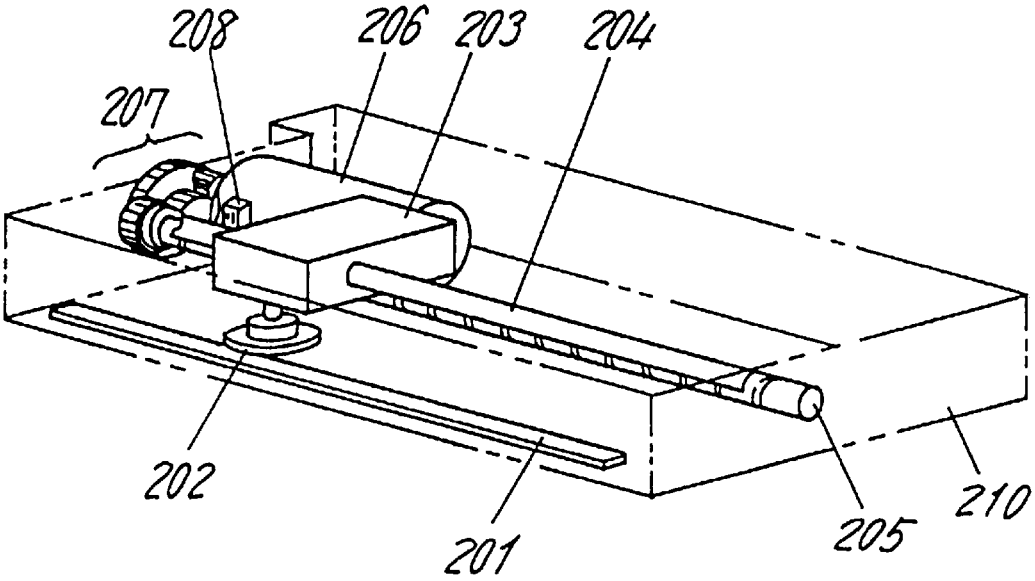
FIG. 7B is a perspective view of the same.
Figure 8A:
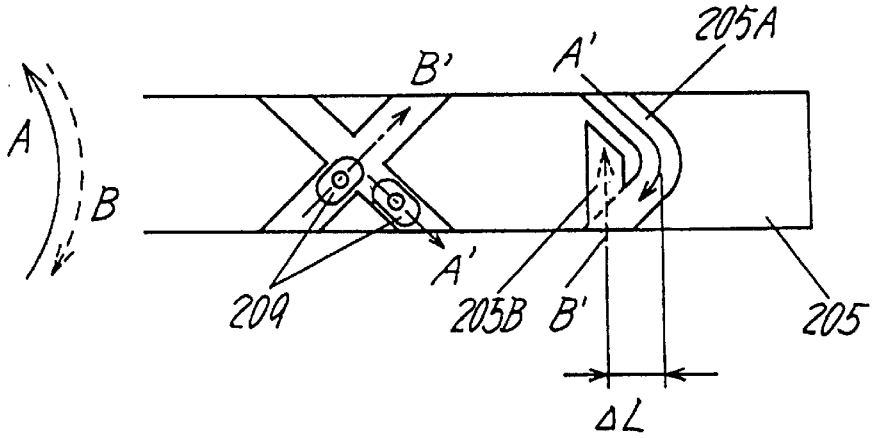
FIG. 8A is an enlarged plan view of an essential part of a cross lead screw for the third exemplary embodiment, and 8B is a cross-sectional view of the same.

FIG. 7A is a plan view depicting a structure of the cutter unit of the third exemplary embodiment of the present invention, and FIG. 7B is a perspective view of the cutter unit of the same exemplary embodiment. FIG. 8A is an enlarged plan view of an essential part of a cross lead screw for the same exemplary embodiment.

In FIGS. 7A–7B, numeral 201 represents a stationary blade of a plate form, numeral 202 represents a circular blade cutter for cutting a recording paper along the stationary blade, and numeral 203 is a carriage for rotatably supporting the circular blade cutter 202. Numeral 204 is a shaft for supporting the carriage 203 to be movable in a rectilinear direction, numeral 205 is a cross lead screw for driving the carriage 203 to move in the direction of the breadth of the paper, and numeral 206 is a motor for providing a driving force. Numeral 207 is a series of gears for transmitting the driving force of the motor 206, numeral 208 is a home position sensor for detecting a starting position of the carriage 203, numeral 209 is an ellipsoidal pin positioned in a groove of the cross lead screw 205 for transmitting a movement of the cross lead screw 205 to the carriage 203, and numeral 210 is a frame for supporting the stationary blade 201, both ends of the shaft 204, the motor 206, the cross lead screw 205 to be rotatable, and the home position sensor 208.

Also in FIG. 8A, an arrow A of solid line indicates a rotational direction of the cross lead screw when it cuts a full breadth of the recording paper (full-cutting), and an arrow B of broken line indicates a rotational direction of the cross lead screw when the cutting length is set shorter than the full breadth of the recording paper (partial-cutting). In addition, an arrow A' and an arrow B' indicate movements of the pin 209 relative to the cross lead screw 205, and they correspond to the rotational directions A and B of the cross lead screw 205 for the full-cutting and the partial-cutting respectively.

Figure 8B:
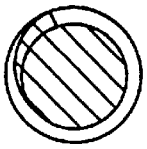

Furthermore, numerals 205A and 205B represent two routes of the groove at one end of the cross lead screw, and they show either of the routes the pin selects according to the rotational direction A or B of the cross lead screw. Here, FIG. 8B depicts an enlarged cross sectional view of an essential portion of the route 205B, showing that the route 205B continues from a bottom of the groove to a periphery of the cross lead screw with a slope.

Operation of this exemplary embodiment is described hereinafter by reference to FIGS. 7A–7B and FIGS. 8A–8B.

In FIGS. 7A–7B, the series of gears 207 provided with the driving force of the motor 206 rotate the cross lead screw 205, converting the force to a reciprocating movement of the carriage 203 by the pin 209 inserted in the groove of the cross lead screw 205. With this reciprocating movement, the circular blade cutter 202 rotates along the stationary blade 201, thereby being able to cut off the recording paper.

At this time, as shown in FIG. 8A, the pin 209 is driven to move in the arrow A' direction when a rotational direction of the cross lead screw is in the direction of the arrow A of solid line, and takes the route represented by the numeral 205A at the end of the cross lead screw so that the moving length of the carriage, i.e. a cutting length of the recording paper, becomes the longest one. On the other hand, if the rotational direction of the cross lead screw is in the direction of the arrow B of broken line, the pin 209 moves in the direction of the arrow B' of broken line by taking the shorter route 205B when reaching the end of the cross lead screw. The moving length of the carriage, i.e. a cutting length of the recording paper, thus shortens at this time by $\Delta L$, which is the difference between 205A and 205B. With an appropriate setting of the length of the cross lead screw and $\Delta L$, partial-cutting can be realized for which the cutting length is made slightly shorter than the breadth of the recording paper to intentionally leave an uncut portion.

As has been described, the present exemplary embodiment enables control of the moving distance of the cutter blade only by selection of the rotational direction of the motor, and makes the cutting position reflector of the prior art unnecessary. Thus advantageous effects are obtained, such as lower cost, a small dispersion in cut lengths of the recording paper, and simplification of assembling process.

Incidentally, the home position sensor 208 is adopted for detecting a starting position of the carriage 203, which reciprocates, and outputs a timing for stopping the motor to rotate after a completion of the reciprocating movement of the carriage.

Another concrete structure of the third exemplary embodiment of the present invention is described next by reference to FIGS. 9A–9B.

Figure 9A:
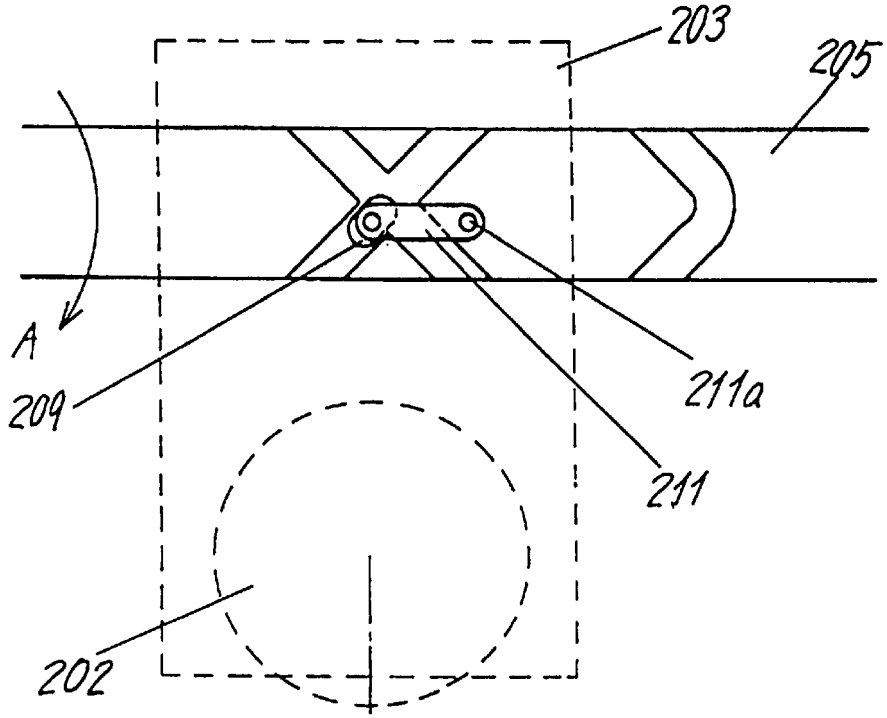
FIGS. 9A and 9B are enlarged plan views of an essential part showing a positional relationship between a cross lead screw and a pin disposed on a carriage in the third exemplary embodiment of the present invention.
Figure 9B:
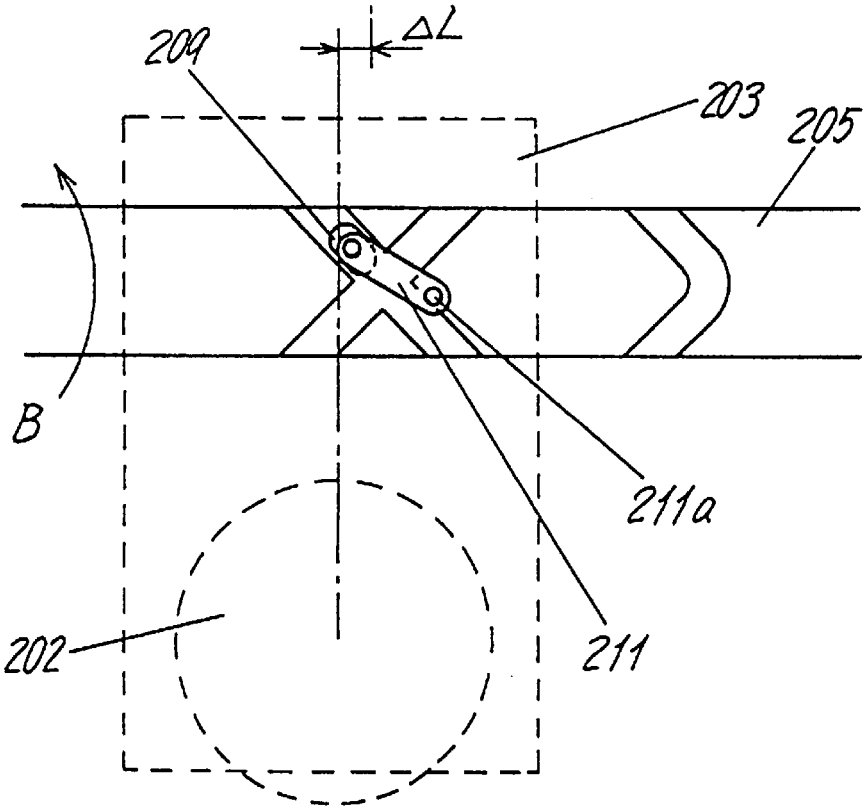

FIGS. 9A–9B are enlarged plan views of an essential part of the cross lead screw, the carriage and the pin to show a structure of the cutter unit of the third exemplary embodiment of the present invention. Description will be omitted for the numerals that are repeated in FIGS. 9A–9B from FIGS. 7A–7B and FIGS. 8A–8B. In the figure, a numeral 211 is an arm and a numeral 211*a* is a center of pivoting at the carriage side of the arm 211. Also, the pin 209 is supported by the arm 211 which is pivotable with respect to the carriage 203, and the movement of the arm 211 is restricted by a pivot restraining member (not shown in the figure). Here, FIG. 9A shows a position at which the pin 209 and the arm 211 move by friction when the cross lead screw rotates in the direction of arrow A, and FIG. 9B shows a position at which the pin 209 and the arm 211 move by friction when the cross lead screw rotates in the direction of arrow B.

An operation of this exemplary embodiment is described hereinafter by referring to FIGS. 9A–9B.

In FIG. 9A, when the cross lead screw 205 is in rotation in the direction of arrow A, the pin 209 inserted in the groove of the cross lead screw receives a friction force in the same direction as the arrow A, and the arm 211 pivots counter-clockwise and stays at the position as shown in the drawing. In FIG. 9B on the other hand, when the cross lead screw 205 is in rotation in the direction of arrow B, the pin 209 inserted in the groove of the cross lead screw receives a friction force in the same direction as the arrow B, and the arm 211 pivots clockwise and stays at the position shown in the drawing.

As a consequence, even though rotational angles of the cross lead screws in FIGS. 9A and 9B remain at the same phase, the moving position of the pin 209 changes due to the pivoting of the arm 211 corresponding to the rotational direction of the cross lead screw, so as to result in a difference ΔL in the positions of the carriage 203 and the circular blade cutter 202. With an appropriate setting of a length of the cross lead screw and ΔL, a full-cutting mode, in which a moving distance of the circular blade cutter 202, i.e. a cutting length, is equal to the breadth of the recording paper, and a partial-cutting mode, in which an uncut portion is intentionally left by making the cutting length slightly shorter than the breadth of the recording paper, can be realized by way of changing the rotational direction of the cross lead screw.

As described above, the present exemplary embodiment enables control of a switching-over of the prescribed cutting length for the recording paper between the full-cutting mode and the partial-cutting mode by changing the rotational direction of the cross lead screw, and makes a cutting position reflector of the prior art unnecessary. Advantageous effects are thus obtained, such as simple and less expensive control circuitry, a small dispersion in cutting lengths of the recording paper, and simplification of the assembling process.

Exemplary Embodiment 4

A concrete structure of paper restraining means of a cutter unit for the printing apparatus equipped with a paper cutter of the present invention is described hereinafter as a fourth exemplary embodiment by referring to FIGS. 10A–10B and FIG. 11.

Figure 10A:
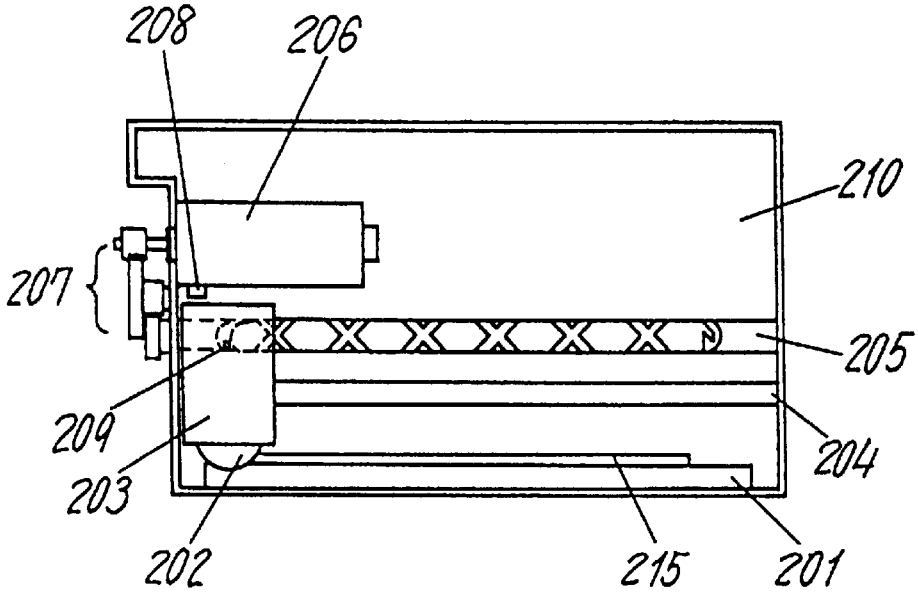
FIG. 10A is a plan view depicting a structure of a cutter unit of a fourth exemplary embodiment of the present invention.
Figure 10B:
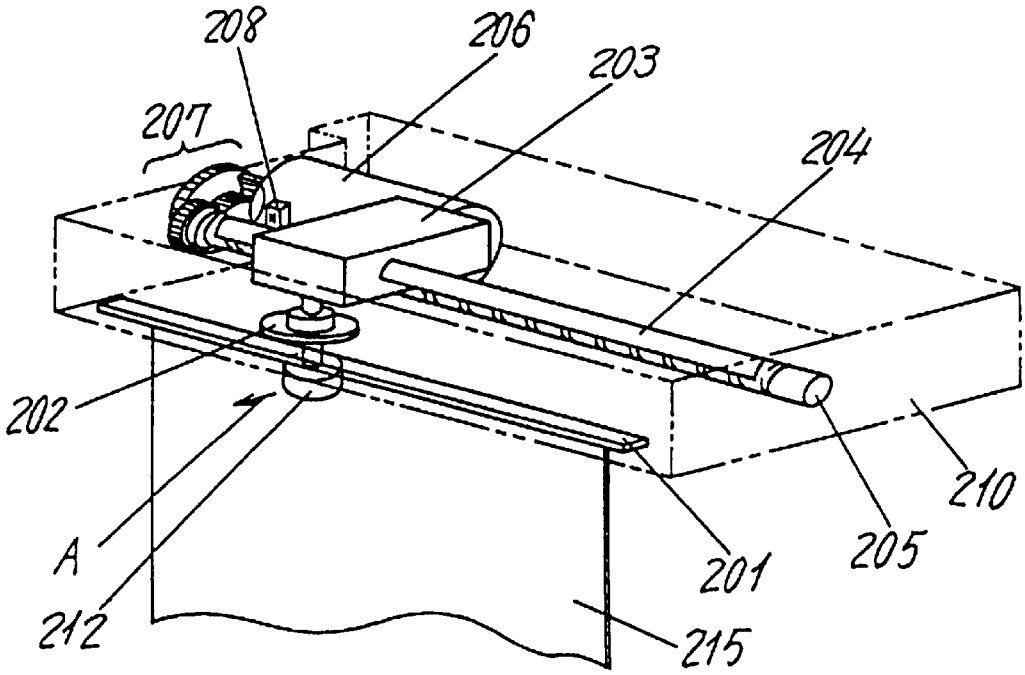
FIG. 10B is a perspective view of the same.

FIG. 10A is a plan view depicting a structure of the cutter unit of the fourth exemplary embodiment of the present invention, and FIG. 10B is a perspective view of the same. FIG. 11 is an enlarged cross-sectional view of an essential part of the recording paper cutting section, showing a relationship among a roller 212 defining the paper restraining means, a frame 210, a carriage 203 and a recording paper 215 of the same exemplary embodiment. The components in FIGS. 10A–10B and FIG. 11 that have the same structure as those of FIGS. 7A–7B are assigned the same reference numerals, and their descriptions will be omitted.

Figure 11:
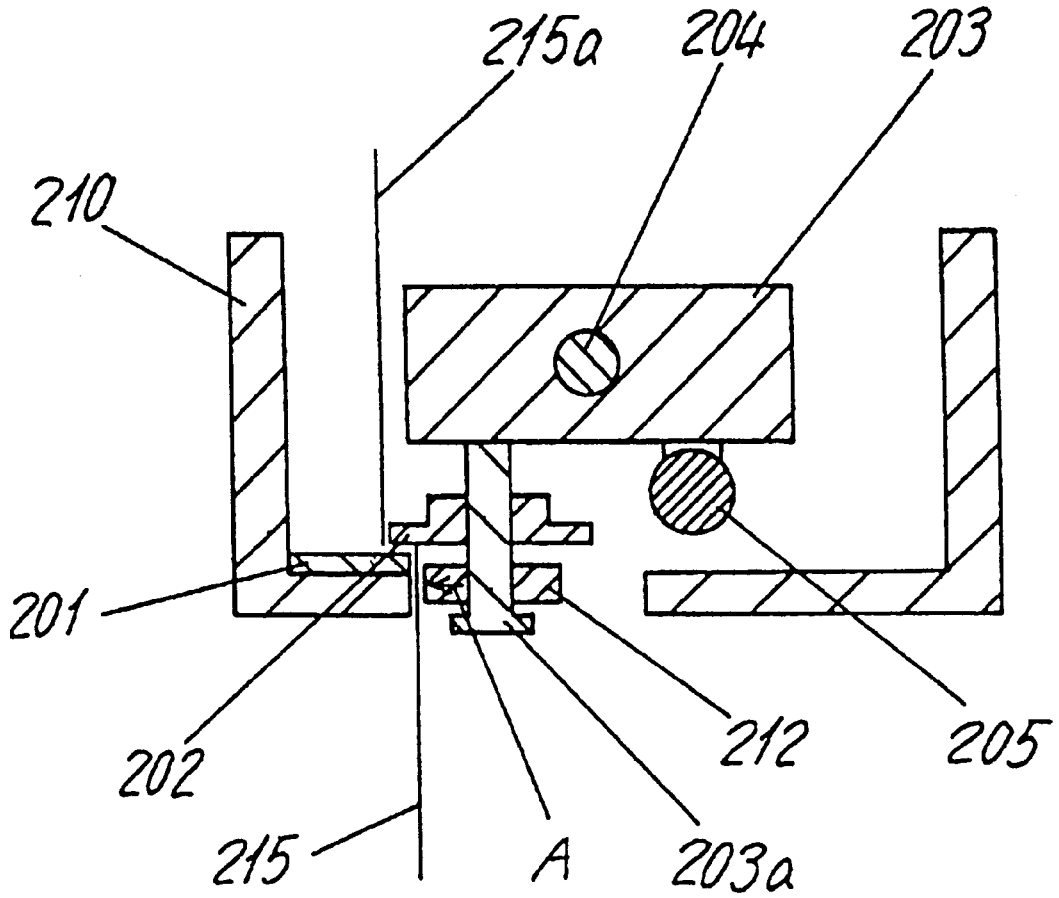
FIG. 11 is an enlarged cross-sectional view of an essential part to show how a recording paper is cut in the fourth exemplary embodiment.

As shown in Figs. 10A–10B and FIG. 11, a rotary blade 202 and the roller 212 defining paper restraining means are rotatably held by a pin 203a of the carriage 203, and recording paper 215 positioned between the stationary blade 201 and the rotary blade 202 is pressed against the frame 210 by the roller 212 in a direction of an arrow A.

An operation of this exemplary embodiment is described hereinafter by referring to FIGS. 10A–10B and FIG. 11.

In Figs. 10A–10B, a driving force of the motor 206 rotates the cross lead screw 205 via a series of gears 207, and causes the carriage 203 to reciprocate by the pin 209 which is inserted in the groove of the cross lead screw. With this reciprocating motion, the rotary blade 202 rotates along the stationary blade 201 to cut the recording paper.

Since the recording paper 215 is pressed against the frame 210 by the roller 212 in the direction of an arrow A as shown in FIG. 11 during this process, the paper neither moves nor crumples at the cut edge even with the force it receives in the direction of paper breadth by the movement of the rotary blade 202. Thus the recording paper is cut straight as shown by a numeral 215*a*.

With the present exemplary embodiment, as has been described, advantageous effects are obtained, such as the recording paper not being likely to crumple at the cut edge when being cut, the paper is cut straight, the probability of paper jams (clogged paper) is reduced and to reduce restrictions on the thickness of the recording paper and the use environment are reduced.

Although the present exemplary embodiment does not specify a material of the roller 212, a better effect can be achieved by using an elastic member such as rubber, as it eliminates the use of resilient members other than the roller itself, such as a coil spring for pressing, and as holding of the recording paper 215 against the frame 210 is reliably made since it increases the friction factor with paper.

Another concrete structure of the fourth exemplary embodiment of the present invention is described next by reference to FIG. 12.

Figure 12:
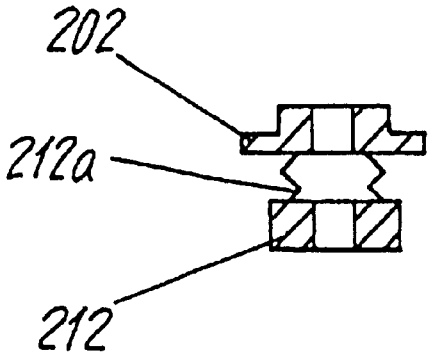
FIG. 12 is a cross-sectional view of an essential part depicting a structure of paper restraining means of the fourth exemplary embodiment.

FIG. 12 is a cross-sectional view of an essential part depicting a structure of a rotary blade and a roller defining a paper restraining means of the cutter unit of the fourth exemplary embodiment of the invention. In FIG. 12, a numeral 212*a* represents rotation transmission means of the bellows type. Descriptions of the other numerals are omitted as they are the same as with FIGS. 10A–10B and FIG. 11.

Here, because the rotation (rotational force) transmission means 212a resiliently connects between the roller 212 and the rotary blade 202, the rotary blade 202 can be forcibly rotated by the rotation of the roller 212 during travelling of the carriage 203.

Accordingly, the rotary blade 202 is continuously rotated while the carriage 203 is in motion. It executes cutting of the recording paper 215 smoothly as the rotation continues even if the recording paper 215 has dust deposited thereon, for instance. The rotary blade 202 also rotates in both directions of reciprocating travel of the carriage 203 so that the rotary blade 202 retains its cutting capability over a long period of time without any local abrasion wear. Moreover, because the rotation transmission means 212*a* is of the bellows type, if a winding motion or a movement in the axial direction of the roller 212 occurs, it is absorbed to maintain a steady close contact at a cutting point between the rotary blade 202 and the stationary blade 201.

As has been described, the present exemplary embodiment is capable of cutting sharply into the recording paper with the rotary blade, and avoiding any movement that prevents close contact between the rotary blade and the stationary blade due to the movement of the roller in the axial direction, so that advantageous effects are obtained. The recording paper is not likely to crumple at the cut edge when being cut, and is reduced, the paper is cut straight, the probability of paper jams (clogged paper) are further reduced and restrictions on the thickness of the recording paper and the use environment.

Although the present exemplary embodiment has specified that the rotation transmission means be of a resilient structure, the same effect is attainable by the rotation transmission means being a rigid body if, on the contrary, close contact between the rotary blade and the roller is sufficiently secured, i.e., by fixing the rotary blade and the stationary blade with adhesive.

Still another concrete structure of the fourth exemplary embodiment of the present invention is described next by reference to FIG. 13.

Figure 13:
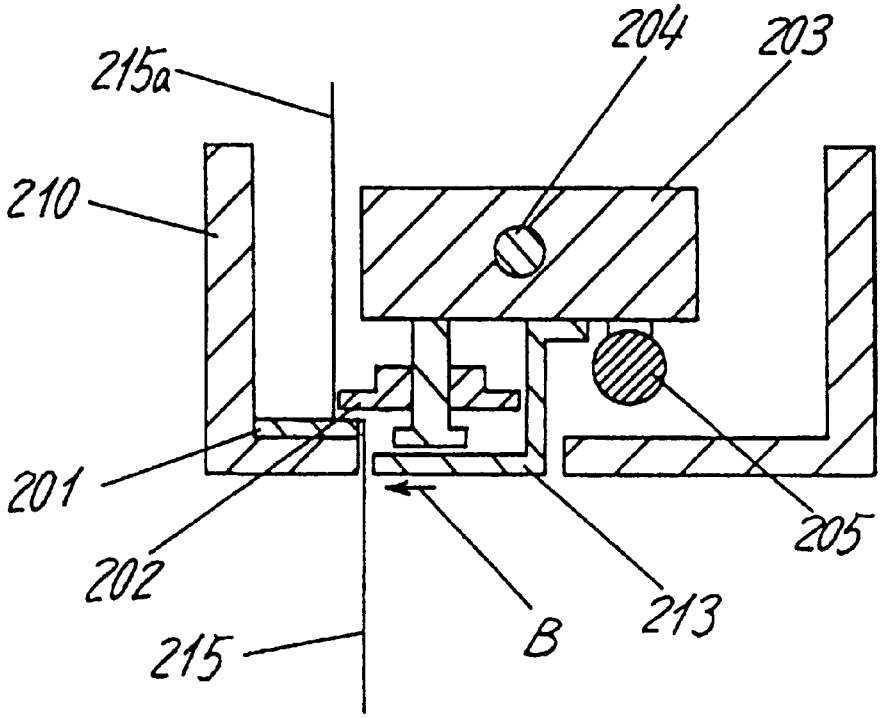
FIG. 13 is an enlarged cress-sectional view of an essential part to show how a recording paper is cut with a cutter unit of the fourth exemplary embodiment of the present invention.

FIG. 13 is an enlarged cross-sectional view of an essential part depicting the recording paper cutting portion to show a relationship among the stationary blade 201, the rotary blade 202, the carriage 203, the frame 210 and recording paper 215 of another cutter unit of the fourth exemplary embodiment of the present invention.

In FIG. 13, a numeral 213 represents a paper restraining means of a resilient body equipped by the carriage 203, while descriptions of the other numerals are omitted as they are repeated with Figs. 10A–10B, FIG. 11 and FIG. 12. The paper restraining means 213 is composed of a leaf spring, and the recording paper 215 is pressed against the frame 210 in a direction of an arrow B by this leaf spring. A surface of the leaf spring which contacts the recording paper 215 is a well polished metal surface having a low friction factor with the recording paper. The frame 210, composed of a polymeric resin by injection molding, has a higher friction factor with the recording paper than the friction factor of the leaf spring with the recording paper.

With the above-described structure, the recording paper 215 in the cutting process can be pressed against the frame 210 in the direction of the arrow B by this leaf spring 213 defining the paper restraining means. The paper neither moves nor crumples at the cut edge with the force it receives in the direction of the paper breadth by the movement of the rotary blade 202. Thus, like the recording paper 215*a,* it is cut straight.

With the present exemplary embodiment, as has been described, advantageous effects are obtainable such as the recording paper not being likely to crumple at the cut edge when being cut, cutting the paper straight, enabling a reduction in the probability of paper jams (clogged paper) and reducing restrictions on the thickness of the recording paper and its use environment.

Although the present exemplary embodiment does not specify any material for the leaf spring 213, a thin sheet of stainless steel material or a thin plate of thermoplastic polymeric resin provided with resiliency is appropriate. A thermoplastic resin is economical, since integral molding into one body is possible by forming the carriage 203 of the same material.

A surface of the thin plate, if molded with a thermoplastic polymeric resin, shall be made accurately in order to reduce friction with the recording paper 215, to the extent that the friction factor is less than that of the frame 210 with the recording paper 215

In addition, although the present exemplary embodiment is constructed with the paper restraining means at an underside of the cutting position of recording paper, that is to say opposite to the traveling direction of the recording paper 215, this is not the only position, and the same effect is attainable if the paper restraining means is disposed at an upper side of the cutting position of recording paper.

Exemplary Embodiment 5

Another concrete structure of paper restraining means of a cutter unit for the printing apparatus equipped with a paper cutter of the present invention is described hereinafter as a fifth exemplary embodiment by referring to FIG. 14A through FIG. 17.

Figure 14A:
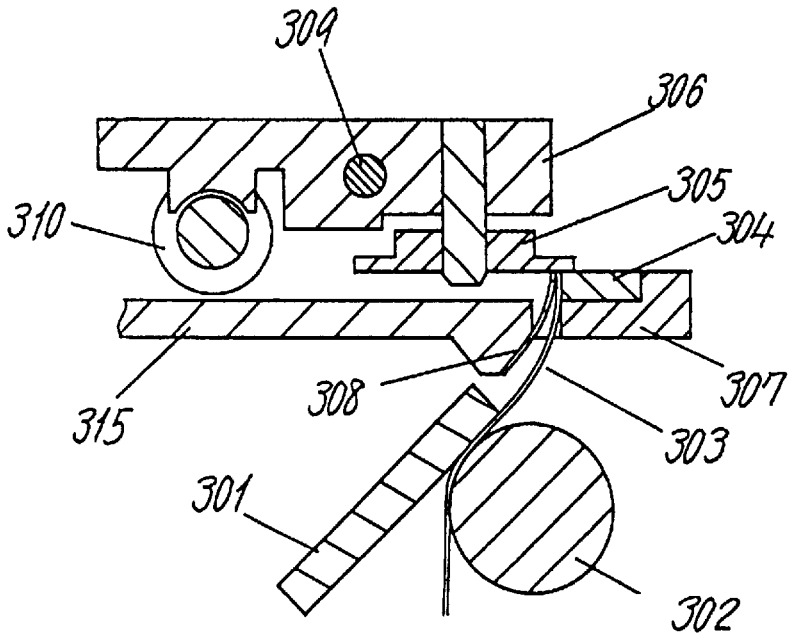
FIG. 14A is a cross-sectional view of an essential part depicting a structure of a cutter unit of a fifth exemplary embodiment of the present invention.
Figure 14B:
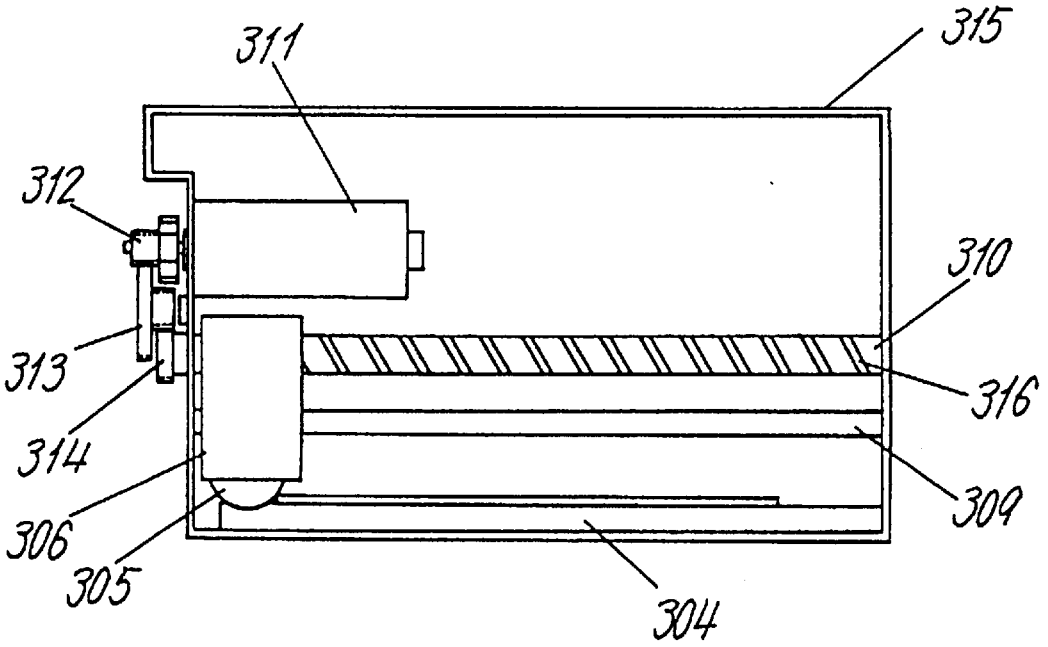
FIG. 14B is a plan view of the same.

FIG. 14A and 14B are a cross-sectional view and a plan view showing a structure of the cutter unit of the fifth exemplary embodiment of the present invention.

In Figs. 14A and 14B, numeral 301 is a thermal head, numeral 302 is a platen roller, and numeral 303 is a recording paper. Numeral 304 is a stationary blade, numeral 305 is a circular blade cutter, numeral 306 is a carriage for rotatably supporting the circular blade cutter 305 for cutting the recording paper 303 while travelling parallel with and along the stationary blade 304. Numeral 307 is a guide for guiding the recording paper 303 into the stationary blade 304 and numeral 308 is a resilient sheet for pressing the recording paper 303 by contact with a contact surface of the stationary blade 304 with the recording paper. Numeral 309 is a carriage shaft for slidably supporting the carriage 306 along with the stationary blade 304, numeral 310 is a rotary axle for slidably supporting the carriage 306, and numeral 311 is a motor for providing a driving force. Numeral 312 is a pinion gear for being provided with a driving force by the motor 311, numeral 313 is a reduction gear for transmitting the driving force of the motor 311, and numeral 314 is a rotary axle gear for driving the rotary axle 310 by rotation of the reduction gear 313. Numeral 315 is a frame for supporting both ends of the carriage shaft 309, pivots at both ends of the rotary axle 310 for making it rotatable, and the motor 311, and numeral 316 is a groove provided on the rotary axle 310.

In the above-described structure, the recording paper 303 held between the thermal head 301 and the platen roller 302, after being printed by the thermal head 301, is guided by the guide 307 to pass through a space between the stationary blade 304 and the resilient sheet 308. It is transferred by the platen roller 302, which is rotated by a driving means that is not shown in the figures, to the extent that a position of the recording paper 303 to be cut comes to a position where the stationary blade 304 is conterminous to the circular blade cutter 305 before coming to a stop.

Then the motor 311 begins to rotate due to a controlling means, which is not shown, and its driving force, transmitted to the pinion gear 312, causes the rotary axle gear 314 to rotate via the reduction gear 313. When the rotary axle 310 rotates with the rotation of the rotary axle gear 314, the carriage 306 moves to slide and reciprocate from side to side by the groove 316 of the rotary axle 310. As the carriage 306 travels along the carriage shaft 309, the circular blade cutter 305 moves along the stationary blade 304 while rotating, and cuts off the recording paper that is held by the resilient sheet 308 near the cutting position.

With the present exemplary embodiment as described above, the resilient sheet 308 is capable of holding the recording paper 303 adjacent the cutting position with the stationary blade 304 and the circular blade cutter 305 by contact with the recording paper contact surface of the stationary blade 304 due to its resiliency. Hence the blade 304 allows the recording paper 303 to be cut without using a roller, prevents the recording paper 303 from moving while it is being cut, even with a guide of a short length, produces a stable cutting result as it avoids meandering at the cutting edge, since the recording paper 303 does not get loose, and thereby enables a reduction in size of the apparatus.

Additionally, in the present exemplary embodiment the resilient sheet 308 does not obstruct cutting the paper, and the assembling work is simplified, as no jigs are required in order to accurately affix the resilient sheet 308, because it can be constructed so that a top edge of the resilient sheet 308 does not jut out from an upper surface of the stationary blade 304, as the top edge can be sheared off if it protrudes beyond the upper surface of the stationary blade 304 by executing the cutting operation.

Figure 15:
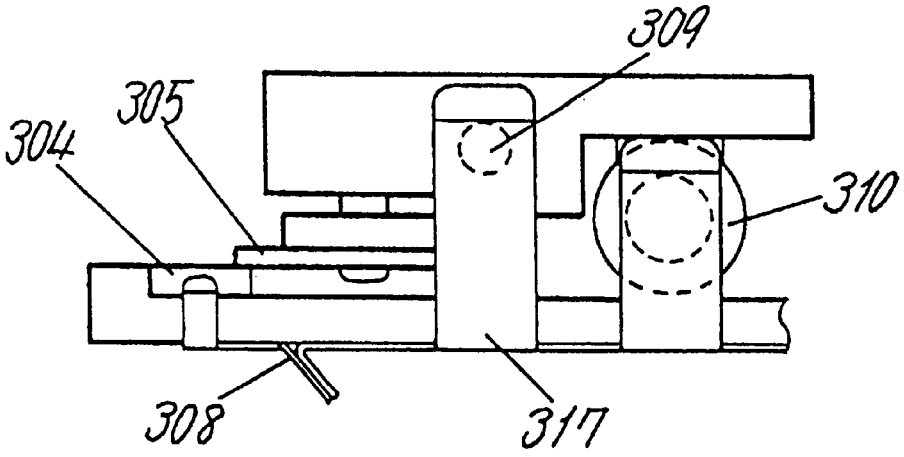
FIG. 15 and FIG. 16 are side views of essential parts depicting structural arrangements of a resilient sheet in the fifth exemplary embodiment.

Also, in a variation of the present exemplary embodiment, the number of parts are reduced and the assembly process is simplified with a structure in which the resilient sheet 308 is disposed on a grounding plate 317 which concurrently serves to ground metal parts as shown in FIG. 15.

Figure 16:
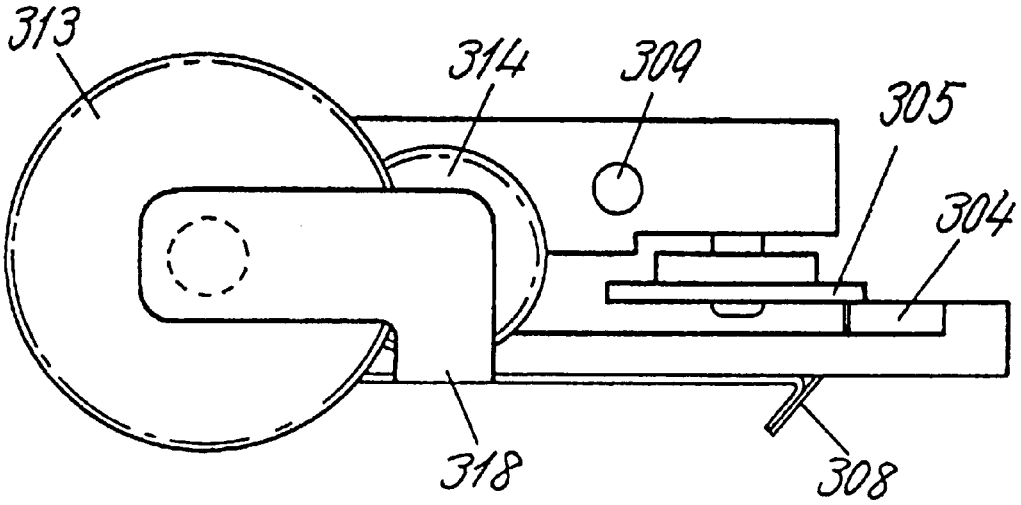

Moreover, in another variation, the number of parts are reduced and the assembly process is simplified with a structure in which the resilient sheet 308 is disposed on a supporting member 318 which concurrently serves to support the reduction gear 313 as shown in FIG. 16.

Figure 17:
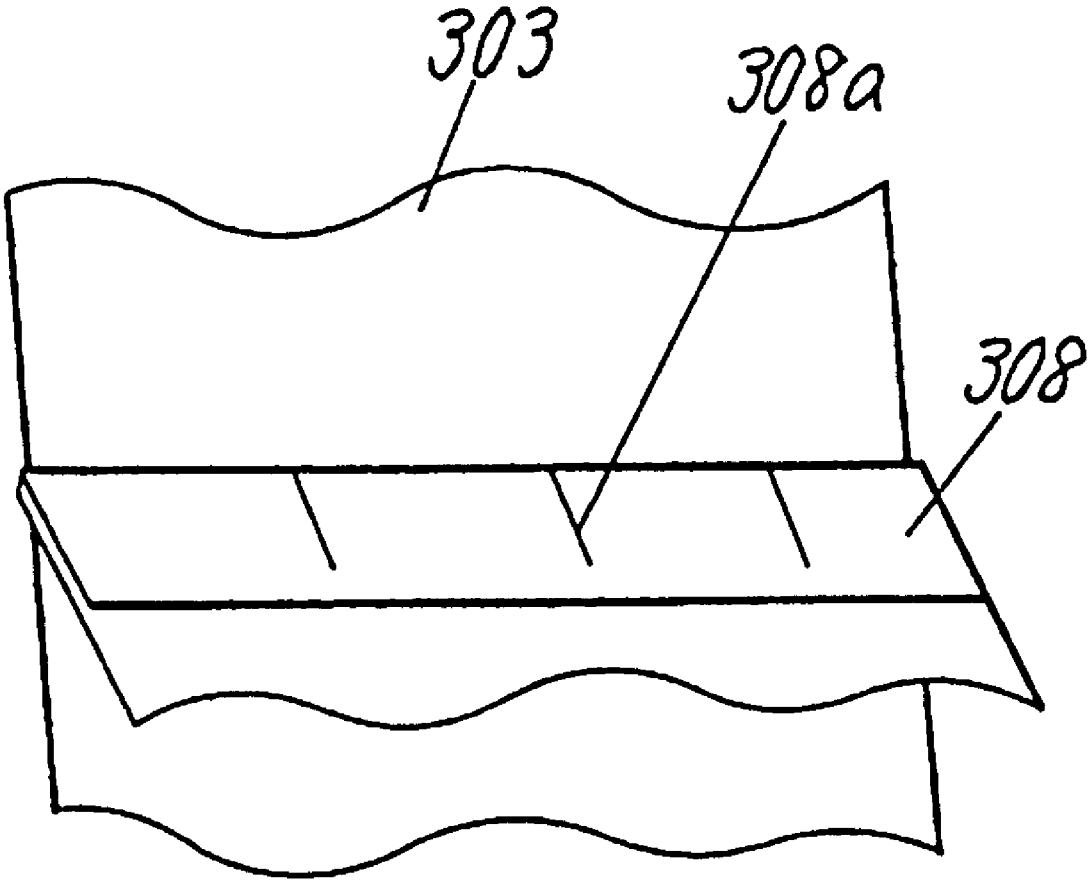
FIG. 17 is a perspective view of an essential part depicting other structure of the resilient sheet of the fifth exemplary embodiment.
Figure 18A:
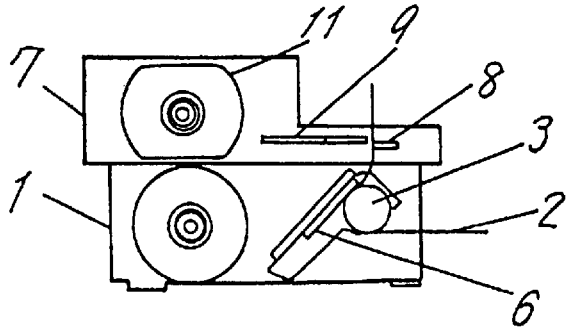
FIG. 18A PRIOR ART
FIG. 18A is a typical side view depicting an outline of a printing apparatus equipped with a paper cutter of the prior art.
Figure 18B:
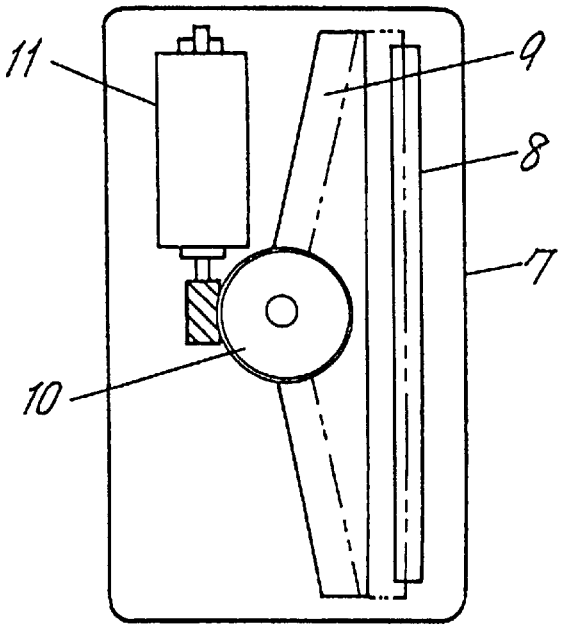
FIG. 18B PRIOR ART
FIG. 18B is a top view depicting a cutter unit of the same.
Figure 18C:
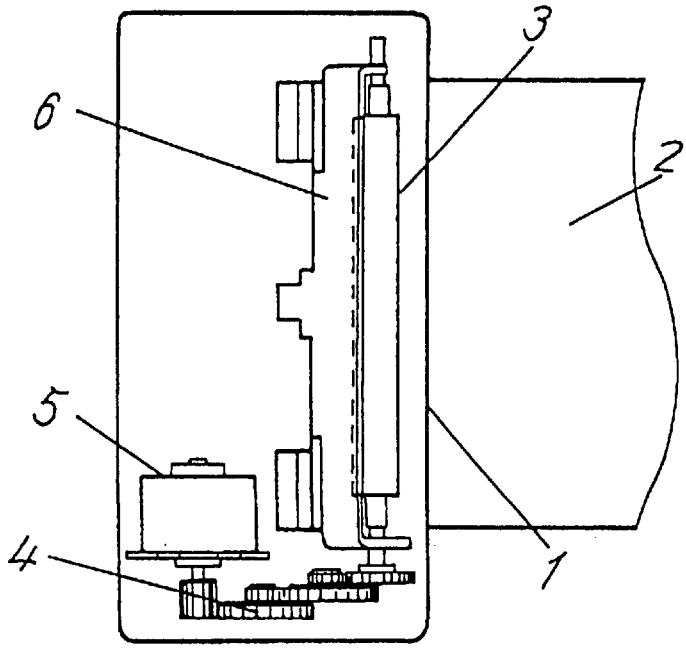
FIG. 18C PRIOR ART
FIG. 18C is a top view depicting a printer unit of the same.

Furthermore, in yet another variation, the resistance during transferring of the recording paper can be reduced by providing a plurality of slits 308a in the resilient sheet 308 as shown in FIG. 17.

As is explicit from what has been described, a printing apparatus equipped with a paper cutter of the present invention is so constructed that a portion of a motor fits in a space provided adjacent to the other motor when a cutter unit and a printer unit are assembled in a stack. With this structure, either one or both of the motors are able to efficiently utilize the space available adjacent to the motors, thereby providing a printing apparatus equipped with a paper cutter which is small, light and thin with a considerably simple structure

What is claimed is:

1. A printing apparatus equipped with a paper cutter comprising a cutter unit and a printer unit, said cutter unit comprising a stationary blade and a rotary blade for cutting recording paper in a direction of paper breadth, a carriage for supporting and moving said rotary blade in the direction of paper breadth of the recording paper, and a cutter motor for transmitting a driving force thereof to said carriage via a first transmission, and said printer unit including a printer head for printing on said recording paper, a platen roller for transferring said recording paper, and a printer motor for transmitting a driving force thereof to said platen roller via a second transmission, wherein a portion of one of said motors fits in a space provided adjacent the other of said motors when said cutter unit and said printer unit are assembled.

2. The printing apparatus equipped with a paper cutter as defined in claim 1, wherein said cutter unit and said printer unit are joined together such that said cutter unit serves as a lid to cover at least a portion of said printer unit and can open and close when said cutter unit and said printer unit are assembled.

3. The printing apparatus equipped with a paper cutter as defined in claim 1 further comprising an exit port for the recording paper provided with said cutter unit and a lid for covering at least a portion of said cutter unit, wherein a side of said lid near said cutter motor and a side of said cutter unit near said cutter motor are joined together such that said lid can open or close at a side near said exit port.

4. The printing apparatus equipped with a paper cutter as defined in claim 3 wherein said cutter unit and said lid are coaxially supported.

5. The printing apparatus equipped with a paper cutter as defined in claim 1, comprising means for cutting the recording paper for a prescribed length by controlling a moving interval of said carriage in the direction of the paper breadth.

6. A printing apparatus equipped with a paper cutter comprising:

a cutter unit comprising a stationary blade and a rotary blade for cutting a recording paper in a direction of paper breadth;

a carriage rotatably supporting said rotary blade for reciprocating travel in the direction of the paper breadth;

a motor for driving said carriage in reciprocating travel;

a rotary member fixed for rotation with said motor, said rotary member having a predetermined number of light reflectors on a periphery thereof; and a frame supporting axially said rotary member and supporting a reflection type optical sensor comprising a light emitting element and a light receiving element at a position relative to the light reflectors of said rotary member;

wherein a printed recording paper can be cut for a prescribed length by controlling a magnitude of travel of said carriage on the basis of rotation detecting signals obtained by detecting the rotation of said rotary member using said light reflectors and said reflection type optical sensor; and a printer unit including a printer head for printing on said recording paper, a platen roller for transferring said recording paper, and a printer motor for transmitting a driving force thereof to said platen roller via a second transmission, wherein a portion of one of said motors fits in a space provided adjacent the other of said motors when said cutter unit and said printer unit are assembled.

7. A printing apparatus equipped with a paper cutter comprising:

a stationary blade and a rotary blade for cutting a recording paper in a direction of paper breadth;

a carriage rotatably supporting said rotary blade for reciprocating travel in the direction of the paper breadth;

a motor for driving said carriage in reciprocating travel; and cutting length selecting means for selecting one of full cutting and partial cutting of the cutting length of a printed recording paper in a direction of the paper breadth, wherein full cutting is selected by rotating said motor in one of forward and reverse directions and partial cutting is selected by rotating said motor in the other of forward and reverse directions.

8. The printing apparatus equipped with a paper cutter as defined in claim 7, wherein said cutting length selecting means comprises:

a cross lead screw capable of being rotatably driven by said motor and having intersecting grooves; and a pin disposed on said carriage for engaging with said grooves;

wherein said carriage travels across the entire paper breadth by continuing rotation of said cross lead screw by rotation of said motor in said one of forward and reverse directions and said carriage makes a U-turn at a turning point that is disposed on said cross lead screw at a position within the paper breadth by continuing rotation of said cross lead screw by rotation of said motor in said other of forward and reverse directions.

9. The printing apparatus equipped with a paper cutter as defined in claim 8, wherein said grooves of said cross lead screw are formed to intersect at a plurality of positions and to have a shorter route leading to said turning point, said shorter route continuing along a slope from a groove bottom to a periphery of said cross lead screw.

10. A printing apparatus equipped with a paper cutter comprising:

a cutter unit comprising a stationary blade and a rotary blade for cutting a recording paper in a direction of paper breadth, said rotary blade having a rotary axle;

a carriage rotatably supporting said rotary blade for reciprocating travel in the direction of the paper breadth;

a cutter motor for transmitting a driving force thereof to said carriage via a first transmission;

a frame movably supporting said carriage and mounting said stationary blade; and a roller rotatably disposed on said carriage for pressing a printed recording paper to be cut against an area adjacent said stationary blade;

wherein said roller and said rotary axle of said rotary blade are coaxial; and a printer unit comprising a printer head for printing on said recording paper, a platen roller for transferring said recording paper, and a printer motor for transmitting a driving force thereof to said platen roller via a second transmission, wherein a portion of one of said motors fits in a space provided adjacent the other of said motors when said cutter unit and said printer unit are assembled.

11. The printing apparatus equipped with a paper cutter as defined in claim 10, further comprising a rotational force transmission between said roller and said rotary blade.

12. A printing apparatus equipped with a paper cutter comprising:

a cutter unit comprising a stationary blade and a rotary blade for cutting a recording paper in a direction of paper breadth;

a carriage rotatably supporting said rotary blade for reciprocating travel in the direction of the paper breadth;

a cutter motor for transmitting a driving force thereof to said carriage via a first transmission;

a frame movably supporting said carriage and mounting said stationary blade; and a resilient piece for forcing a printed recording paper to be cut against an area adjacent said stationary blade;

wherein said resilient piece is one body with said carriage; and a printer unit comprising a printer head for printing on said recording paper, a platen roller for transferring said recording paper, and a printer motor for transmitting a driving force thereof to said platen roller via a second transmission, wherein a portion of one of said motors fits in a space provided adjacent the other of said motors when said cutter unit and said printer unit are assembled.

13. In a printing apparatus equipped with a paper cutter for printing on a recording paper with said printing apparatus and for cutting the recording paper with said paper cutter after the printing, said printing apparatus equipped with a paper cutter comprises:

a frame;

a stationary blade mounted on said frame;

said paper cutter being capable of cutting the recording paper by moving along said stationary blade; and a resilient sheet mounted on said frame for forcing said recording paper against said stationary blade, wherein a printed recording paper, before being cut, is retained by force with the resiliency of said resilient sheet at an area adjacent a cutting position of said stationary blade and said paper cutter.

14. The printing apparatus equipped with a paper cutter as defined in claim 13, wherein a top edge of said resilient sheet is set to protrude above an upper surface of the stationary blade, and the protruded portion is cut by the cutter, thereby making said resilient sheet capable of retaining the recording paper by force at an area adjacent a cutting position of said stationary blade and said paper cutter.

15. The printing apparatus equipped with a paper cutter as defined in claim 13, wherein said resilient sheet is disposed on a curved portion of a metal member positioned under the frame and provided with a ground.

16. The printing apparatus equipped with a paper cutter as defined in claim 13, wherein said resilient sheet is disposed on a curved portion of a supporting member for supporting driving and transmission gears positioned under the frame.

17. The printing apparatus equipped with a paper cutter as defined in claim 13, wherein said resilient sheet is provided with a plurality of slits at a side which contacts the recording paper.

* * * * *